US008360642B2

(12) United States Patent
Sun

(10) Patent No.: US 8,360,642 B2
(45) Date of Patent: Jan. 29, 2013

(54) SUPER AIR PERMEABILITY AND REINFORCED SEAMS OF PEANUTS BAG (APC BAG-SBA)

(76) Inventor: Jianyi Sun, Duluth, GA (US)

( * ) Notice: Subject to any disclaimer, the term of this patent is extended or adjusted under 35 U.S.C. 154(b) by 1537 days.

(21) Appl. No.: 11/825,172

(22) Filed: Jul. 5, 2007

(65) Prior Publication Data

US 2011/0229063 A1 Sep. 22, 2011

(51) Int. Cl.
*B65D 30/04* (2006.01)

(52) U.S. Cl. ..... 383/117; 383/6; 383/105; 383/67

(58) Field of Classification Search ..... 383/6, 66, 383/67, 105, 117, 119
See application file for complete search history.

(56) References Cited

U.S. PATENT DOCUMENTS

| | | | | | |
|---|---|---|---|---|---|
| 3,554,437 | A * | 1/1971 | Kimsey | 383/206 |
| 3,661,695 | A * | 5/1972 | Berliner | 428/215 |
| 3,939,969 | A * | 2/1976 | Miller et al. | 206/63.3 |
| 4,147,291 | A * | 4/1979 | Akao et al. | 383/113 |
| 4,253,507 | A * | 3/1981 | Williamson | 383/6 |
| 4,253,563 | A * | 3/1981 | Komarnycky | 206/63.3 |
| 4,759,473 | A * | 7/1988 | Derby et al. | 222/105 |
| 5,071,699 | A * | 12/1991 | Pappas et al. | 442/110 |
| 5,300,345 | A * | 4/1994 | Aihara et al. | 428/137 |
| 5,478,154 | A * | 12/1995 | Pappas et al. | 383/117 |
| 5,512,355 | A * | 4/1996 | Fuson | 442/185 |
| 5,518,314 | A * | 5/1996 | Kawafuchi et al. | 383/22 |
| 5,679,449 | A * | 10/1997 | Ebadat et al. | 442/110 |
| 5,789,368 | A * | 8/1998 | You et al. | 510/297 |
| 6,020,275 | A * | 2/2000 | Stevenson et al. | 442/60 |
| 6,021,915 | A * | 2/2000 | Shimozono et al. | 220/666 |
| 6,063,418 | A * | 5/2000 | Sugimoto et al. | 426/127 |
| 6,112,772 | A * | 9/2000 | Ebadat et al. | 139/1 R |
| 6,572,942 | B2 * | 6/2003 | Wurr et al. | 428/36.1 |
| 2009/0148081 | A1 * | 6/2009 | Rogers | 383/204 |
| 2011/0085749 | A1 * | 4/2011 | Frei et al. | 383/117 |

* cited by examiner

*Primary Examiner* — Justin Larson
*Assistant Examiner* — Peter Helvey
(74) *Attorney, Agent, or Firm* — Baker Donelson Bearman Caldwell & Berkowitz, PC

(57) ABSTRACT

A ventilated bulk bag formed of a first fabric of interwoven yarns that define gaps therebetween to be air permeable, with a top panel formed of a second fabric of first yarns with a first cross-sectional shape and second yarns of a second cross-sectional shape interwoven in a second alliance to defines gaps adjacent the interwoven yarns, which gaps are apparent when viewed from an oblique angle relative to a plan view of the top panel, for keeping dust landing thereon from going through the gaps but allowing the top panel to ventilate air through the gaps.

17 Claims, 3 Drawing Sheets

SUPER AIR PERMEABILITY AND REINFORCED SEAMS OF PEANUTS BAG (APC BAG-SBA)

TECHNICAL FIELD

This invention provides an improved (FIBC) bulk bag used for packaging purposes, more particularly by commercial industries. This invention solves the contamination problems, help keep the ventilation functioning and reinforced seams that are stronger than normal on (FIBC) Bulk Bag.

BACKGROUND OF THE INVENTION

FIBCs stand for Flexible Intermediate Bulk Containers, "so-called bulk bags." This kind of packaging has been invented for over 20 years. Manufacturers have adopted different materials and fabrics to make this kind of packaging to perform different functions. The most common bulk bag is made by polypropylene fabric with flat yarns interwoven method. (FIG. 6)

Some industries need their packaging to be ventilated, they have tried to adjust alliance of flat yarns to keep regular gaps 34 between yarns 32 in order to create a ventilated bag (see FIG. 7). Although, it seems that a ventilated bag have been made, but side effect of using polypropylene fabric with flat yarns interwoven method created problem of contamination. Dust can fall and settle through the gaps of fabric, other particles and bugs can go through the gaps between the yarns and cause contamination problem.

The American Peanut Council (APC) has designed a special bag for peanuts in the year 2004 referred to as APC tote bag. In the same year APC Tote Bag Council was created to regulate and improve the APC Tote Bag. The Council has set the standard for air permeability to the minimum 20 cfm for top fabric. Currently in the Flexible Intermediate Bulk Container (FIBC) industry, companies only have one method to produce the woven fabric with the minimum air permeability. The method is to weave the flat yarns sparsely in order to keep space between the yarns. Using this method to construct the bags meet the American Peanut Council standards, however it has unsolvable problems. Dust falling and settling through the gaps of the APC bags. Particles and bugs going through the gaps between the yarns can contaminate the peanuts; bugs can easily lay eggs on the top of the bags which will contaminate the peanuts. Current woven methods will not solve the problems of contamination because the method lacks the ability to provide more air permeability within the bag. In order to increase more air permeability, companies have tried using larger gaps in the weave but had little success.

SUMMARY OF THE PRESENT INVENTION

The present invention provides a ventilated bulk bag, comprising a ventilated bag body having a bottom panel and a side wall thereof to define a cavity for receiving bulk articles and a top panel that attaches to the bag body. The top panel is formed of a fabric of first yarns in a first direction and second yarns in a second direction traverse to the first direction, the first yarns having a first cross-sectional shape and the second yarns having a second cross-sectional shape different from that of the first yarns, the first yarns and the second yarns interwoven in an alliance whereby the fabric defines gaps adjacent a respective crossing of the interwoven first yarns and second yarns, which gaps are not apparent in a plan view of the fabric, for keeping dust landing thereon from going though the gaps but allowing the top panel to ventilate air through the gaps from the cavity. A discharge spout attaches to the bottom panel and a top spout attaches to the top panel. Air, being ventilated into the cavity through the ventilated bag body, ventilates from the cavity through the gaps in the fabric of the top panel while the fabric keeps dust that lands on the top panel from going through into the cavity.

DETAILED DESCRIPTION

Definition of Some Key Words

APC Bag: a kind of bag that can hold 2400 lbs. of redskin or blanched kernels, or 2200 lbs. of split kernels, or 1000 lbs. of inshell peanuts.

(FIBC) Bulk Bag: Flexible Intermediate Bulk Container

Small Woven Bag: This bag made by Polypropylene or Polyethylene, using interwoven method. This bag can hold 25 lbs. to 100 lbs.

Yarn: The same meaning as strap.

After further research I have created and claim the process for increasing more air permeability in the FIBC bulk bags 10 comprising of a fabric called monofilament 12. I have discovered that monofilament fabric 12 has the unique feature for super (higher) air permeability along with a tighter weave. As of today, monofilament fabric is only used in the GEO-textile industries; no one has ever thought that this fabric could be applied to the FIBC Industry.

Figure 1:
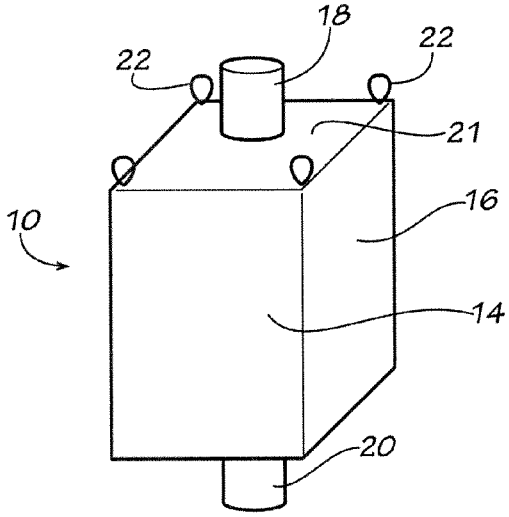
FIG. 1 illustrates the construction of a bulk bag (APC Bag or FIBC).

In 2007, I invented a bag 10 called BAG-SBA to solve contamination problems and to keep the ventilation functioning at all time. This bag 10 is made by monofilament fabric 12 partially. My clients especially in the Peanut Industry have great success using my bag and widely accepted by the FIBC industry. I haven't seen any bag made by monofilament fabric 12 completely or partially before my invention. Because all FIBC bulk bags are formed by U-Panel 14 and Side Panels 16 (if the bag is circular in design we used Main Body instead of U-Panel and Side Panels), Top and Discharge Spouts 18, 20, Top Panel 21 and Lifting Loops 22 (as shown in FIG. 1). According to the invention, I have used the monofilament fabric 12 instead of normal woven fabric as the Top Panel 21 to provide super air permeability. Research has proven that moisture (steam) moves from the bottom to top, so the Top Panel 21 has to function for the moisture to escape.

Figure 5:
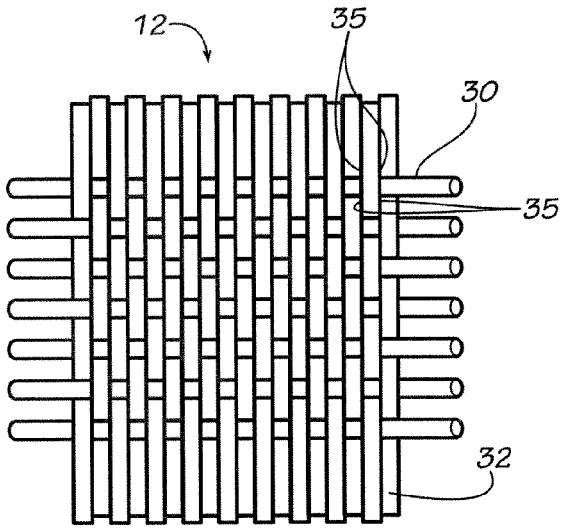
FIG. 5 illustrates the construction of a monofilament fabric.
Figure 6:
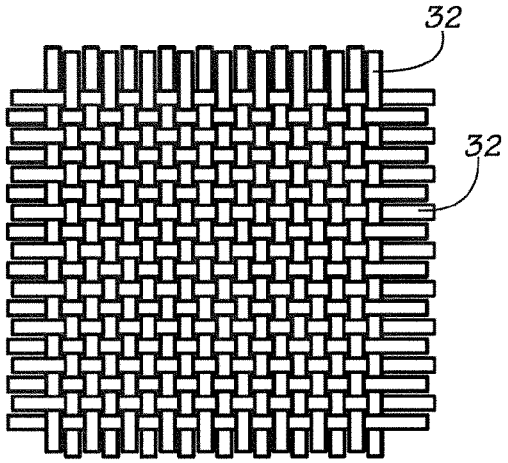
FIG. 6 illustrates the construction of a normal woven fabric.
Figure 7:
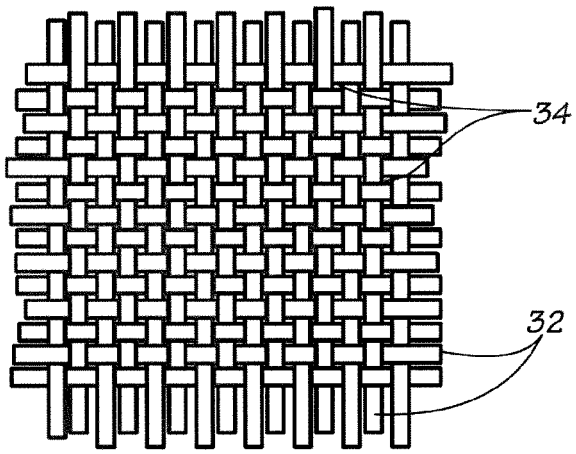
FIG. 7 illustrates the construction of a normal woven fabric with gaps.

The method according to the present invention, the top panel 21 fabric is then constructed with super air permeability that will make the entire bag 10 perform with the breath ability. The monofilament fabric 12 (see FIG. 5) is made by monofilament yarns 30 and flat yarns 32. According to the drawing the flat yarns 32 located at machine direction (MD) and monofilament yarns 30 located at cross machine direction (XD). The configuration show that no matter what the direction the yarns are in the fabric is still interwoven by monofilament yarns 30 and flat yarns 32 interwoven together, the fabric will be named Monofilament Fabric 12. When the monofilament fabric 12 is woven slightly tight, it doesn't appear to have any gaps 35 when exam from 90° angle (or, in plan view as shown in FIG. 5). The gaps appeared only when exam the weave (fabric) from a 45° angle. This feature will keep out dust landing and going through the fabric, but still be able to keep the fabric ventilated.

Figure 2:
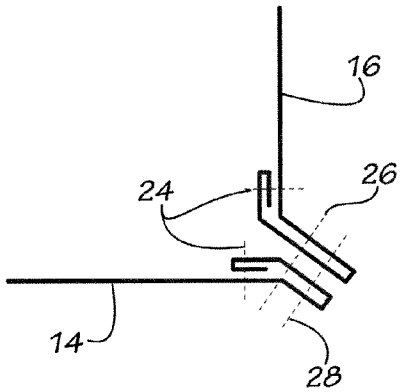
FIG. 2 illustrates in plan form a section of a seam between a U-panel and a side panel showing a reinforced fold and stitching method for APC Bag.

As shown in FIG. 2, the reinforced seams 33 used to stitch the bulk bag 10 were independently designed at our test lab, not a requirement by The American Peanut Council. I designed the seams 33 between U-Panel 14 and Side Panels 16 all which to be double folded along with special stitching (FIG. 2). As shown by (FIG. 2) both of the edges of U-Panel 14 and Side Panels 16 have been double folded, and the raw edges have been folded inside and stitched invisibly.

Figure 3:
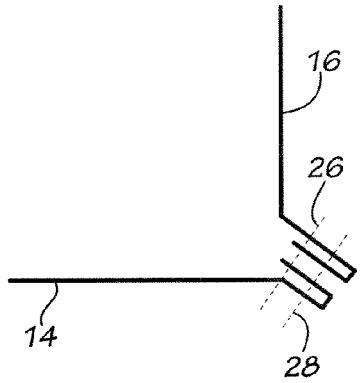
FIG. 3 illustrates in plan form a section of a seam between a U-panel and a side panel showing a normal fold and stitching method of bulk bag.
Figure 4:
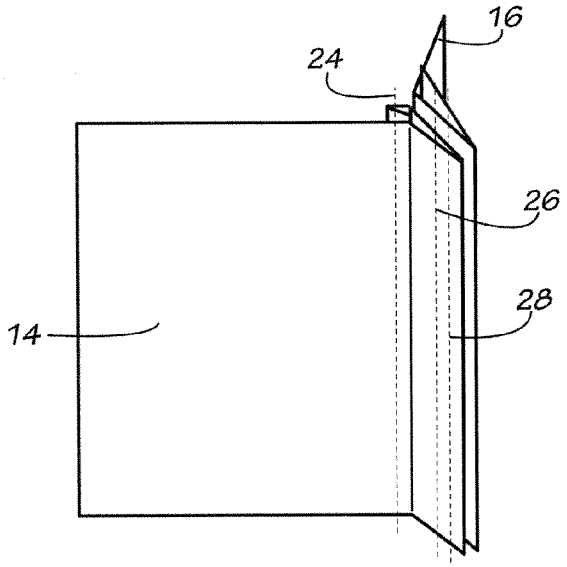
FIG. 4 illustrates a section of a seam between U-panel and side panel showing a reinforced fold and stitching method for APC Bag.

The method according to the invention will provide two distinct advantages for the newly designed FIBC tote bag. First this method will prevent loose fibers from falling inside the bag. Second the junctions will have the double connective strength making the bag stronger than normal design (shown in FIG. 3).

The method according to the invention of the seam, the sewing thread 24 (see FIG. 2) is very important in this invention because without it the edges of the panel will not join together and have the advantages of double connective strength. We designed the double fold 33 for the edges, the width of first fold is 1.5" to 5", and the width of second fold is 0.5" to 4".

According to the invention, monofilament fabric 12 are use on FIBC Bulk Bag and small woven bag. Whatever the bag design may be, others cannot use the monofilament fabric 12 as the top fabric 21, spouts 18, 20 fabric, and body fabric of bulk bag (FIBC). Also others cannot use the monofilament fabric 12 as the body of small woven bag. I am the first one to use the monofilament in the packaging industry. I claim the exclusive right to use the monofilament fabric 12 for packaging material.

According to the seam invention, reinforced fold 33 and stitching method threads 24, 26, and 28 for APC Bag. I claim the width between 1.5" to 5" double or single fold of main body seams 33 (or the seams 33 between U-Panel 14 and Side Panels 16) and sewn edge onto main body of fabric applied to the APC Bag.

The invention claimed is:

1. A ventilated bulk bag, comprising:

a ventilated bag body having a bottom panel and side walls to define a cavity for receiving bulk articles;

a top panel that attaches to the bag body, the top panel formed of a fabric of first yarns in a first direction and second yarns in a second direction traverse to the first direction, the first yarns having a first cross-sectional shape and the second yarns having a second cross-sectional shape different from that of the first yarns, the first yarns and the second yarns interwoven whereby the fabric defines gaps adjacent respective crossings of the interwoven first yarns and second yarns, which gaps are apparent when viewed from a 45 degree angle relative to a plan view of the fabric, for keeping dust landing thereon from going though the gaps but allowing the top panel to ventilate air through the gaps from the cavity;

a discharge spout attached to the bottom panel; and a top spout attached to the top panel, whereby air, being ventilated into the cavity through the ventilated bag body, ventilates from the cavity through the gaps in the fabric of the top panel while the fabric keeps dust that lands on the top panel from going through into the cavity.

2. The ventilated bulk bag as recited in claim 1, wherein a fabric for the ventilated bag body is formed of interwoven flat yarns.

3. The ventilated bulk bag as recited in claim 1, wherein the first yarns are flat yarns and the second yarns are monofilament.

4. The ventilated bulk bag as recited in claim 1, wherein the first yarns are flat yarns and the second yarns are circular in cross-section.

5. The ventilated bulk bag as recited in claim 1, wherein the interweaving of the first yarns and the second yarns is such that the gaps in the fabric are not apparent when viewed from a 90° angle thereto.

6. The ventilated bulk bag as recited in claim 1, wherein the bag body comprises a U-shaped panel and opposing side panels.

7. The ventilated bulk bag as recited in claim 6, wherein the bag body has seams between the U-panel and the side panels, which seams comprise adjacent respective edge portions that are double folded with raw edges folded inwardly thereof and stitched together.

8. The ventilated bulk bag as recited in claim 7, wherein the seams are secured with a first and second sewing thread stitched through adjacent double folded edge portions of the U-panel and the side panels.

9. The ventilated bulk bag as recited in claim 8, further comprising a third sewing thread stitched through the inwardly folded raw edge and the fabric panel thereof.

10. The ventilated bulk bag as recited in claim 9, wherein a width of the folded edge portion that defines the seam is between 1.5 inches and 5 inches.

11. The ventilated bulk bag as recited in claim 1, further comprising a plurality of lifting loops attached to the bag body.

12. A ventilated bulk bag, comprising:

a bag body formed of a first fabric of a plurality of interwoven flat yarns and having a bottom panel and side walls to define a cavity for receiving bulk articles, the flat yarns interwoven to define gaps between adjacent ones of the flat yarns for the first fabric to be air permeable;

a top panel formed of a second fabric of a plurality of flat yarns woven in a first direction and a plurality of monofilament yarns woven in a second transverse direction, and the flat yarns and the monofilament yarns interwoven together such that the second fabric defines gaps adjacent respective crossings of the interwoven flat yarns and monofilament yarns, which gaps are readily apparent when viewed from a 45 degree angle relative to a plan view of the second fabric, for keeping dust that lands on the top panel from going though but allowing the top panel to ventilate air from the cavity;

a discharge spout attached to the bottom panel; and a top spout attached to the top panel, whereby air, being ventilated into the cavity through the gaps in the first fabric may ventilate from the cavity through the gaps in the top panel while the second fabric keeps dust landing on the top panel from going through into the cavity.

13. The ventilated bulk bag as recited in claim 12, wherein the monofilament yarns have a cross-sectional shape different from that of the flat yarns.

14. The ventilated bulk bag as recited in claim 12, further comprising a plurality of lifting loops attached to the bag body.

15. The ventilated bulk bag as recited in claim 12, wherein the monofilament yarns are circular in cross-section.

16. The ventilated bulk bag as recited in claim 12, wherein the bag body comprises a U-shaped panel and opposing side panels.

17. The ventilated bulk bag as recited in claim 16, wherein the bag body has seams between the U-panel and the side panels, which seams comprise adjacent respective edge portions that are double folded with raw edges folded inwardly thereof and stitched together.

* * * * *

UNITED STATES PATENT AND TRADEMARK OFFICE

CERTIFICATE OF CORRECTION

PATENT NO. : 8,360,642 B2
APPLICATION NO. : 11/825172
DATED : January 29, 2013
INVENTOR(S) : Jianyi Sun It is certified that error appears in the above-identified patent and that said Letters Patent is hereby corrected as shown below:

In the Claims:

Claim 1, Column 3, line 65, change “though” to --through--.
Claim 12, Column 4, line 56, change “though” to --through--.

Signed and Sealed this
Twenty-fifth Day of June, 2013

Teresa Stanek Rea
*Acting Director of the United States Patent and Trademark Office*